US005480340A

United States Patent [19]

Bogar

[11] Patent Number: 5,480,340

[45] Date of Patent: Jan. 2, 1996

[54] CRIB TOY HAVING REMOVABLE PLUSH FIGURE

[75] Inventor: Brett M. Bogar, Torrance, Calif.

[73] Assignee: Mattel, Inc., El Segundo, Calif.

[21] Appl. No.: 311,684

[22] Filed: Sep. 23, 1994

[51] Int. Cl.[6] ..... A63H 33/00; A63H 21/02; A63H 3/02

[52] U.S. Cl. ..... 446/227; 446/268; 446/369

[58] Field of Search ..... 446/71, 72, 73, 446/127, 128, 227, 268, 313, 369, 370, 371, 372, 390, 901, 484, 485

[56] References Cited

U.S. PATENT DOCUMENTS

| | | | |
|---|---|---|---|
| D. 275,693 | 9/1984 | Gregory . | |
| 2,955,382 | 10/1960 | Boles | 446/227 |
| 3,927,482 | 12/1975 | Marcus . | |
| 4,091,563 | 5/1978 | Noble et al. | 446/227 X |
| 4,170,686 | 10/1979 | Hills | 446/372 |
| 4,174,059 | 11/1979 | Maunder | 446/73 X |
| 4,449,321 | 5/1984 | Reiling . | |
| 4,453,339 | 6/1984 | Cook . | |
| 4,551,114 | 11/1985 | Hyman et al. | 446/227 X |
| 4,573,654 | 3/1986 | Nottingham . | |
| 4,600,399 | 7/1986 | Abe . | |
| 4,624,647 | 11/1986 | Munnix | 446/127 X |
| 4,662,855 | 5/1987 | Morrison . | |
| 4,755,160 | 7/1988 | Autore . | |
| 4,763,369 | 8/1988 | Spector . | |
| 4,904,220 | 2/1990 | Williams et al. . | |
| 4,950,196 | 8/1990 | Fortune et al. | 446/73 |
| 4,968,279 | 11/1990 | Smith . | |
| 4,973,286 | 11/1990 | Davison . | |
| 5,030,160 | 7/1991 | Klawitter . | |
| 5,057,051 | 10/1991 | Babicz | 446/227 |
| 5,071,385 | 12/1991 | Cox . | |
| 5,083,966 | 1/1992 | Blank | 446/371 X |
| 5,114,376 | 5/1992 | Copley et al. . | |
| 5,211,075 | 5/1993 | Martin-Rossman . | |
| 5,288,257 | 2/1994 | Zacherl | 446/313 X |
| 5,350,333 | 9/1994 | Croyle | 446/371 X |

FOREIGN PATENT DOCUMENTS

| | | | |
|---|---|---|---|
| WO90/08582 | 8/1990 | France . | |
| 583408 | 12/1946 | United Kingdom | 446/390 |
| 2224949 | 5/1990 | United Kingdom | 446/369 |

*Primary Examiner*—Robert A. Hafer
*Assistant Examiner*—D. Neal Muir
*Attorney, Agent, or Firm*—Roy A. Ekstrand

[57] ABSTRACT

A crib toy includes a front housing and a rear housing securable to the vertical supports of a conventional crib sidewall. A threaded fastener extends between the housings and provides a drawing force therebetween to secure the housings to the crib wall vertical supports. The front and rear housings include attachment devices for removably securing the legs of a plush toy figure to the housings in a manner such that the toy figure straddles the crib sidewall and assumes a "peering over" or "peeking in" appearance. A sound circuit is supported within the front housing and is actuated by a depressible button on the interior face thereof.

11 Claims, 1 Drawing Sheet

CRIB TOY HAVING REMOVABLE PLUSH FIGURE

FIELD OF THE INVENTION

This invention relates generally to devices known in the art as crib toys and particularly to those intended to be secured to the crib sidewall.

BACKGROUND OF THE INVENTION

Musical crib toys have enjoyed substantial popularity for many years and as a result have been provided in a virtually endless variety of shapes, sizes, configurations and styles. The basic object of such musical crib toys is to provide amusement and entertainment to soothe and occupy an infant resting within the crib. To meet the needs of consumers for such crib toys, practitioners in the art have provided toys ranging from simple music boxes to highly intricate mobiles having revolving elements or the like. Still others have been provided with interactive features such as push buttons and activity elements intended to be manipulated by the infant within the crib. The great majority of such crib toys attach to the crib sidewall and extend into the space above the resting infant or are positioned upon the crib sidewall at a sufficiently low position to be reachable by the infant. Another interesting variant of crib toys are those having mechanisms which provide for movement along the upper rail or top edges of the crib sidewalls.

U.S. Pat. No. 4,453,339 issued to Cook sets forth a MUSICAL RAIL ROCKER providing a crib toy having a rocking pony shape outer shell with a downwardly facing U-shaped aperture therein. The aperture includes a clamp adapted to fit over different sized cribs to secure the pony thereto. The shell contains a mechanism having an output shaft which drives a gear train for rocking the pony through a slidable connecting device while music is played by an internal sound mechanism.

U.S. Pat. No. 3,927,482 issued to Marcus sets forth a DECORATIVE NURSERY ACCESSORY having a housing securable to a convenient surface and supporting a rotatable mobile above an infant. The housing supports a motor drive and music box coupled to a flexible shaft. The remaining end of the flexible shaft is coupled through the mobile support to a plurality of rotatable elements supported by the mobile.

U.S. Pat. No. 4,449,321 issued to Rieling sets forth a CRIB TOY is capable of back and forth motion along a crib rail by operation of a reversing mechanism. An internal wind-up drive propulsion system is supported within the toy and rotatably coupled to the rail surface to drive the toy. The reversing mechanism includes a support plate spring-biased between first and second positions which is reciprocally moved between the first and second positions for respective engagement of first and second gears within the drive means using a cam surface and cam follower.

U.S. Pat. No. 4,573,654 issued to Nottingham sets forth a MOUNTING STRUCTURE FOR A CRIB TOY having a mounting bracket which is adjustable for accommodating various constructions and sizes of crib rails as well as convertible to a self-supporting stand or mounting a toy thereto. The toy is removably secured to the mounting bracket such that it may be removed for independent play.

U.S. Pat. No. 4,600,399 issued to Abe sets forth a SEQUENTIAL ACTION TOY HAVING A PLURALITY OF CAMS in which a housing supports a motor drive having an output drive disk and further supports a center pivoted lever having extending portions to which toy figures are secured. Sequential cams provide relative movement of the lever and toy figure in response to motor drive.

U.S. Pat. No. 4,662,855 issued to Morrison sets forth a pop-up crib toy having a housing securable to a crib surface and a movable figure supported on the upper portion thereof. An internal motor drive operates a vertically displaceable rod coupled to the pop-up figure for raising and lowering the pop-up figure from the housing.

U.S. Pat. No. 4,904,220 issued to Williams, et al. sets forth a PUPPET MOBILE having a clamp securable to a crib surface or the like and supporting an elongated upwardly extending curved member. The curved member in turn supports a downwardly hanging puppet formed to replicate a plurality of plush animals.

U.S. Pat. No. 4,968,279 issued to Smith sets forth an INFANT TOY formed of a quilted fabric material stuffed with a cotton batting to form a pillow-like body. The pillow-like body is preferably formed in an ornamental shape and supports a plurality of hook and loop fastening strips which in turn support a corresponding plurality of fabric patches having cooperating fasteners formed in a variety of ornamental shapes, textures and sizes.

U.S. Pat. No. 4,973,286 issued to Davison sets forth a MULTIPLE ACTIVATION CRIB TOY having a housing together with a clamp for securing the housing to a convenient portion of an infant crib. An internal circuit within the crib toy produces a musical output and provides predetermined motions of a plurality of activated cartoon-like figures. A microphone supported by the housing responds to the sounds produced by the noise producing apparatus to trigger musical output.

PCT publication WO90/08582 sets forth a MOBILE HAVING DIVERSE MOVEMENTS in which a plurality of freely moving figures are each supported by a rotating element and connected to a lateral rod. The lateral rods are coupled to a rotating element within the mobile toy to provide movement thereof.

U.S. Pat. No. 5,114,376 issued to Copley, et al. sets forth a TOY ANIMAL WITH ILLUMINATED BELLY in which an animal-shaped body includes an illuminatable belly portion. A cavity in the belly portion houses accessories, electrical circuitry and a power source required to provide illumination of a domed-shaped member covering the belly cavity.

U.S. Pat. No. 5,071,385 issued to Cox sets forth a POSABLE FIGURE having a head torso and limbs covered by a fabric. Magnets mounted under the fabric within the figure's limbs are joinable with opposing magnets mounted under the fabric within the figure's head to pose the figure.

U.S. Pat. No. 5,030,160 issued to Klawitter sets forth a LIGHT DISPLAY APPARATUS including a shaft and a support platform mounted for rotation about the shaft. A light bracket mounted on the support revolves about an axis offset from the shaft and lamps mounted on the light bracket at a position offset from the bracket access. The support is revolved by either mechanical gearing or directly by the motor.

U.S. Pat. No. 4,763,369 issued to Spector sets forth a TRANSFORMABLE PILLOW which in its normal mode serves as a comfortable bedrest and in its transformed mode functions as a plaything. The pillow is formed of a soft compressible inner bag and a removable outer case which covers the bag. Means such as drawstrings or elastic bands are provided to encircle the outer case and constrict the pillow.

U.S. Pat. No. 4,755,160 issued to Autore sets forth a STUFFED TOY ANIMAL HAVING SPIRAL-SHAPED FORM-RETAINING APPENDAGES AND METHOD OF FABRICATION THEREFOR formed of a compliance material and stuffed with a film material.

U.S. Patent Des. 275,693 issued to Gregory sets forth a DOLL having a generally circular torso and head coupled to elongated extending arms each of which supports a hook and loop fabric attachment for securing the arm hands together.

U.S. Pat. No. 5,211,075 issued to Martin-Rossman sets forth a HANDLEBAR MOUNTED BIKE ASSEMBLY including a spring securable to the upper portion of a handlebar and a figurine member releasibly engageable with the handlebar spring to provide resilient support of the figure upon the handlebar.

While the foregoing described prior art devices have provided improvements in crib toys and other related toy areas, there remains nonetheless a continuing need in the art for evermore improved flexible and adaptive crib toys for use by infants and young children.

SUMMARY OF THE INVENTION

Accordingly, it is a general object of the present invention to provide an improved crib toy. It is a more particular object of the present invention to provide an improved crib toy having flexibility of use to enhance the play value of the crib toy.

In accordance with the present invention, there is provided for use in combination with a children's crib having a sidewall having spaced apart supports, a crib toy comprises: a front housing defining a front face and a rear face; a rear housing; clamping means for securing the front and rear housings to the crib sidewall; a plush toy figure having a plurality of appendages; and attachment means for removably attaching the appendages to the front and rear housings such that the plush toy figure straddles the crib sidewall.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
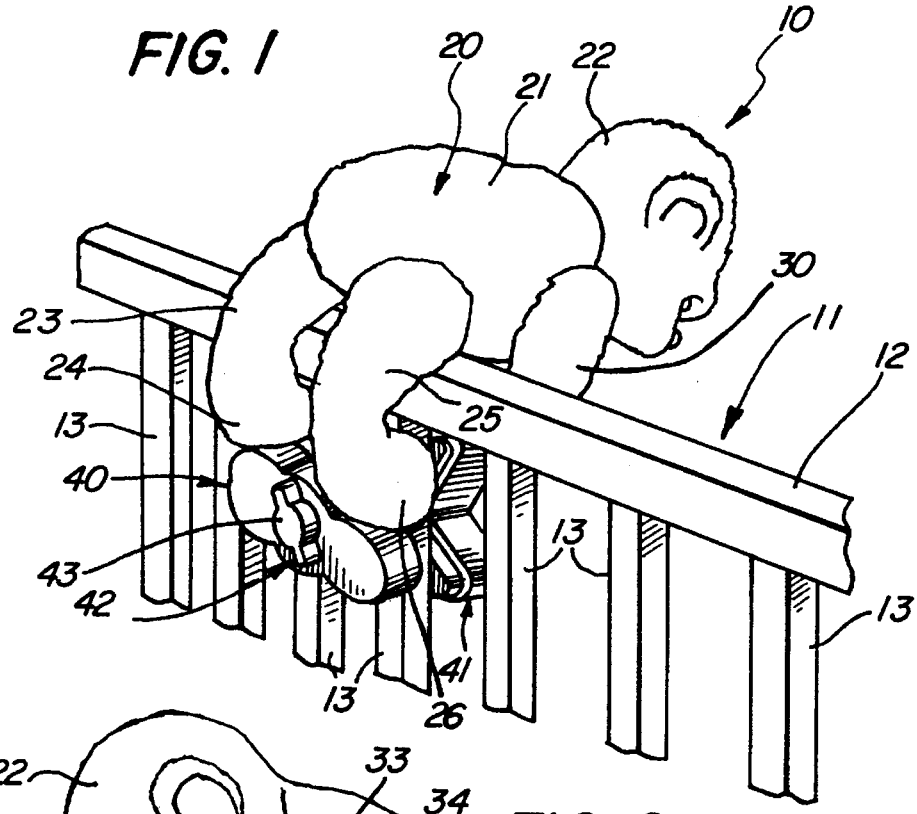
FIG. 1 sets forth a rear perspective view of a crib toy constructed in accordance with the present invention.

FIG. 1 sets forth a rear perspective view of a crib toy constructed in accordance with the present invention and generally referenced by numeral 10. Crib toy 10 is shown secured to a conventional crib generally referenced by numeral 11. In accordance with conventional fabrication techniques, crib 11 includes an upper rail 12 supported by a plurality of vertically extending spaced apart vertical supports 13. Crib toy 10 includes a plush figure generally referenced by numeral 20 having a torso 21, a head 22, a pair of legs 23 and 25 and a pair of arms 30 and 33 (the latter seen in FIG. 2). Leg 23 terminates in a foot 24 while leg 25 terminates in a foot 26. Similarly and as is better seen in FIG. 2, arm 30 terminates in a front paw 31 having a fabric attachment pad 32 secured thereto while arm 33 terminates in a front paw 34 having a fabric attachment pad 35 secured thereto.

Figure 2:
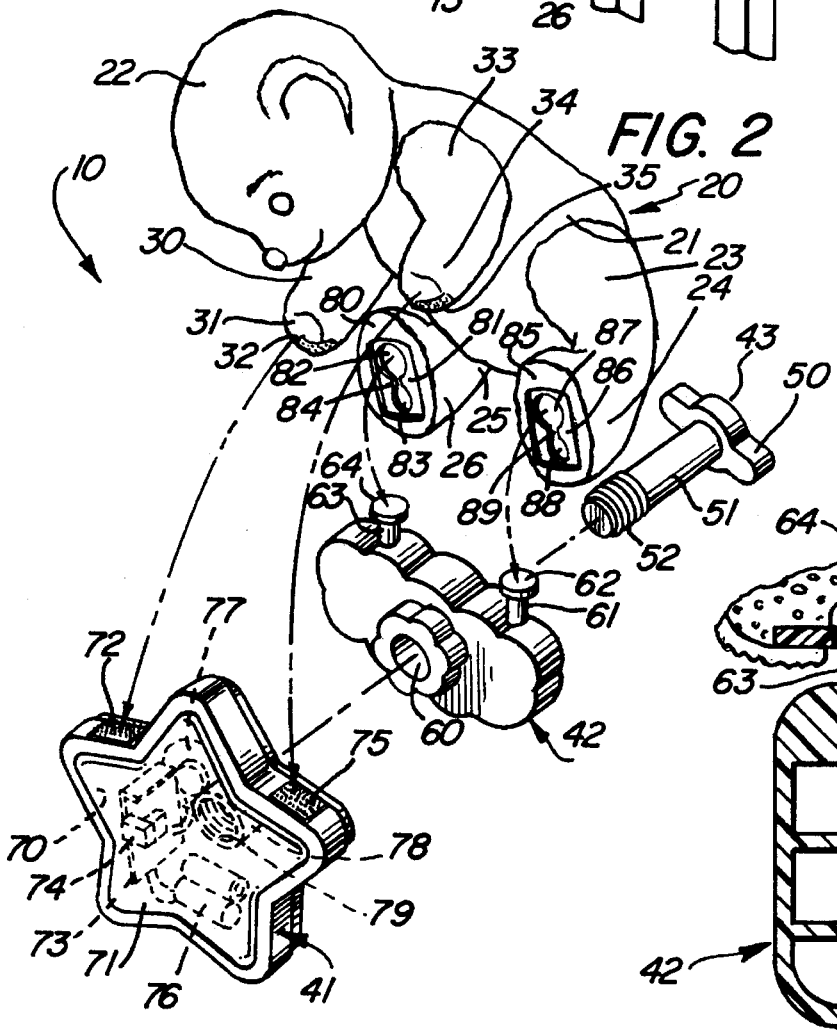
FIG. 2 sets forth a front perspective assembly view of the present invention crib toy.

Returning to FIG. 1, crib toy 10 further includes a front housing 41 and a rear housing 42. Front housing 41 is shown in FIG. 2 to be fabricated in a star shape. However, it will be apparent to those skilled in the art that other shapes for front housing 41 may be utilized without departing from the spirit and scope of the present invention. Rear housing 42 is fabricated in a fanciful cloud shape having a generally elongated structure sufficient to span the spacing of an adjacent pair of vertical supports 13 of crib 11. It will be similarly apparent to those skilled in the art that rear housing 42 may be shaped in a variety of configurations to provide the desired aesthetic appeal for the present invention crib toy. A fastener 43 is received within rear housing 42 and by means shown in FIG. 2 in greater detail passes through rear housing 42 and is received within and engages front housing 41. As a result, the tightening of fastener 43 draws front housing 41 against the interior surface of vertical supports 13 while concurrently drawing rear housing 42 against the exterior surfaces thereof to provide a clamping attachment which secures housings 41 and 42 to an adjacent pair of vertical supports 13.

In accordance with the present invention, plush FIG. 20 further includes cooperating attachment means formed on the upper portion of rear housing 42 and the undersurface of feet 24 and 26. This attachment means is better seen in FIG. 2 and is described in greater detail below. However, suffice it to note here that feet 24 and 26 are removably securable to rear housing 42. Additional attachment means are provided which cooperate to secure front paws 30 and 34 to the upper portion of front housing 41 thereby securing plush FIG. 20 in the position shown in FIG. 1. The attachment means for front paws 31 and 34 are set forth below in FIG. 2 in greater detail. However, suffice it to note here that front paws 31 and 34 are removably securable to front housing 41 to facilitate the attachment of plush FIG. 20 to housings 41 and 42 in a removable manner. In the position shown in FIG. 1, plush FIG. 20 straddles upper rail 12 of crib 11 and faces downwardly into the space normally occupied by the infant within crib 11. As such, plush FIG. 20 provides a friendly comforting presence above an infant within crib 11 which simulates the appearance of plush FIG. 20 "peering" over upper rail 12 and looking downwardly at the infant within crib 11. Concurrently, the attachment of plush FIG. 20 to housings 41 and 42 is secure and reliable and prevents and infant within crib 11 from pulling plush FIG. 20 loose and drawing the figure downwardly into the crib area. In particular, the attachment set forth below between feet 24 and 26 to rear housing 42 maintains his safe reliable feature and avoids injury to the infant user within crib 11.

In the event, however, it is desired to separate plush FIG. 20 from housings 41 and 42, the parent or supervising adult may readily do so in the manner described below thereby making plush FIG. 20 available for a conventional play pattern for such plush figures. In further accordance with an important aspect of the present invention, the attachment mechanisms utilized to secure plush FIG. 20 to housings 41 and 42 is unobtrusive in the separated state and does not detract from the normal use of plush FIG. 20.

In its preferred form, crib toy 20 further includes a conventional sound producing circuit supported within front housing 41 which may provide appropriate sound such as music or the like to further enhance the play value of plush FIG. 20. In the preferred embodiment of the present invention set forth in FIGS. 1 through 3, housing 41 supports a depressible push button 71 (seen in FIG. 2) which is accessible from the interior of crib 11 and which operates and controls the sound circuit. This facilitates the operation by the child user in which the child user is able to interact with the crib toy as push button 71 (seen in FIG. 2) is pushed and music is turned on.

FIG. 2 sets forth a front perspective assembly view of crib toy 10. As described above, crib toy 10 includes a plush FIG. 20, a front housing 41, a rear housing 42 and a fastener 43. More specifically, plush FIG. 20 includes a torso 21 and a head 22. Plush FIG. 20 further includes a pair of arms 30 and 33 having front paws 31 and 34 respectively which in turn support a pair of fabric attachment pads 32 and 35 respectively. Plush FIG. 20 further includes a pair of legs 23 and 25 having feet 24 and 26 formed therein. Foot 24 defines a bottom surface 85 while foot 26 defines a bottom surface 80. In accordance with the present invention, bottom surface 85 of foot 24 supports an attachment cleat 86 which is preferably formed of a molded plastic material or the like. Cleat 86 is secured to foot 24 by conventional fabrication techniques and defines a larger aperture 87 and a smaller aperture 88 coupled by a narrow slot 89. Similarly, an attachment cleat 81 substantially identical to cleat 86 is secured to foot 26 in accordance with conventional fabrication techniques. By way of further similarity, cleat 81 defines a larger aperture 82, a smaller aperture 83 and a narrow connecting slot 84 extending therebetween.

Front housing 41 is preferably formed of a molded plastic material or the like and defines a generally star-shaped outer periphery. Front housing 41 further defines a star-shaped recess 70 within which a correspondingly star-shaped push button 71 is resiliently supported by conventional fabrication techniques. Thus, push button 71 is resiliently movable with respect to front housing 41 by resilient support means not shown. Front housing 41 is generally hollow and supports a conventional sound producing circuit 73 having a depressible switch 74 within the interior of front housing 41. Sound circuit 73 includes conventional means for producing electrical signals corresponding to a pleasing sound such as music or the like in response to the operation of switch 74. Front housing 41 further supports a plurality of conventional batteries 76 and a conventional speaker 77 both operatively coupled to sound circuit 73 in accordance with conventional fabrication techniques. Front housing 41 further supports a pair of fabric attachment pads 72 and 75 on opposed upper surfaces of housing 41. Attachment pads 72 and 75 preferably comprise conventional hook and loop attachment pads which cooperate with attachment pads 32 and 35 of plush FIG. 20 to provide removable attachment of front paws 31 and 34 of plush FIG. 20 to housing 41. Housing 41 also defines an internal threaded boss 78 defining a plurality of interior threads 79.

Rear housing 20 defines a center passage 60 extending therethrough and a pair of upwardly extending generally cylindrical posts 61 and 63. Posts 61 and 63 terminate in generally circular head portions 62 and 64. Heads 62 and 64 are substantially larger in diameter than posts 61 and 63. Fastener 43 is preferably formed of a molded plastic material or the like and includes a generally cylindrical shaft having a plurality of threads 52 formed at one end thereof. Fastener 43 further includes a pair of outwardly extending twist tabs 50 at the remaining end of fastener 43 to provide an easily manipulated grip for the user.

In operation, front housing 41 is initially positioned within the interior of crib 11 such that front housing 41 spans an adjacent pair of vertical supports 13 (seen in FIG. 1). Thereafter, rear housing 42 is positioned in an overlying relationship with front housing 41 at the exterior of crib 11 such that passage 60 is aligned with threaded boss 78 of housing 41. Thereafter, fastener 43 is passed through passage 60 and threaded into boss 78 with sufficient tightening to secure housing 41 and housing 42 to the adjacent pair of vertical supports for crib 11. Thereafter, plush FIG. 20 may be assembled to housings 41 and 42 in the "peering over" position shown in FIG. 1 by initially aligning larger apertures 82 and 87 of cleats 81 and 86 respectively with heads 64 and 62 of posts 63 and 61. Apertures 82 and 87 receive heads 64 and 62 due to their larger size. Thereafter, cleats 81 and 86 are forced against posts 63 and 61 such that posts 63 and 61 are passed through slots 84 and 89 of cleats 81 and 86. Once posts 63 and 61 are forced through slots 84 and 89, they are received within smaller apertures 83 and 88. Because heads 64 and 62 of posts 63 and 61 are substantially larger than apertures 83 and 88, cleats 81 and 86 are securely attached to rear housing 42.

Finally, the assembly of plush FIG. 20 is completed by extending torso 21 across upper rail 12 (seen in FIG. 1) and extending front paws 31 and 34 downwardly to force attachment pads 32 and 35 against attachment pads 72 and 75 to complete the attachment therebetween. At this point, plush FIG. 20 is completely secured to housings 41 and 42. Thereafter, the child user is able to actuate sound circuit 73 as desired by manipulating push button 71 to turn sound circuit 73 on and off.

Plush FIG. 20 is removable from housings 41 and 42 by essentially reversing the above-described assembly process. Front paws 31 and 34 are separated from housing 41 by separating attachment pads 32 and 35 from attachment pads 72 and 75. Thereafter, cleats 81 and 86 are forced outwardly with respect to rear housing 42 forcing posts 63 and 61 through narrow slots 84 and 89 of cleats 81 and 86 into larger apertures 82 and 87. Thereafter, feet 24 and 26 may be withdrawn from housing 42 as heads 64 and 62 pass through larger apertures 82 and 87.

Figure 3:
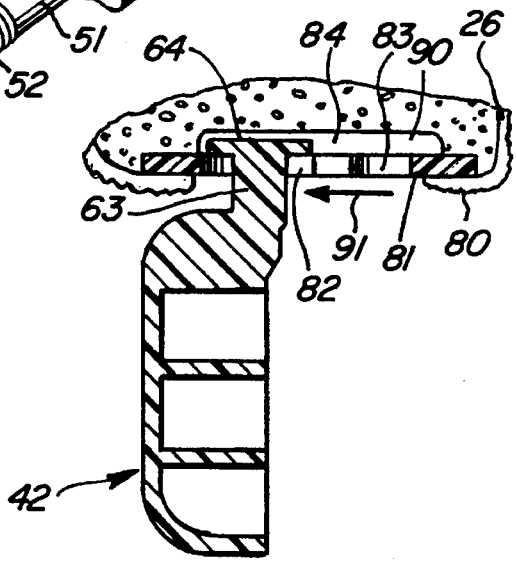
FIG. 3 sets forth a partial view of the removable attachment mechanism of the present invention crib toy.

FIG. 3 sets forth a partial section view of the attachment between rear housing 42 and foot 26 using cleat 81. As described above, cleat 81 defines a larger aperture 82, a smaller aperture 83 and a narrow slot 84 extending therebetween. Foot 26 defines a recess 90 extending above and generally coextensive with apertures 82 and 83 and slot 84 of cleat 81. The function of recess 90 is to provide clearance for head 64 of post 63. Thus, the particular shape of recess 90 is not important so long as sufficient clearance for head movement is provided.

Rear housing 42 defines a generally cylindrical post 63 having a circular enlarged head 64. In the position shown in FIG. 3, foot 26 has been aligned with rear housing 42 such that head 64 of post 63 may be passed through larger aperture 82 into recess 90. The assembly of foot 26 to rear housing 42 is completed by forcing foot 26 in the direction indicated by arrow 91 which in turn moves cleat 81 correspondingly and forces slot 84 against post 63 beneath head 64. The resilient character of cleat 81 permits a slight flexing of slot 84 thereby permitting post 63 to be passed through slot 84 and into aperture 83. Aperture 83 is smaller in diameter than head 64 and as a result head 64 captivates post 63 within aperture 83 of cleat 81 completing the attachment of foot 26 to rear housing 42. Separation of foot 26 from rear housing 42 is carried forward in essentially the reverse manner by forcing foot 26 in the opposite direction to that indicated by arrow 91 and again forcing post 63 through slot 84 and into larger aperture 82. This essentially returns foot 26 to the position shown in FIG. 3. Head 64 is smaller in diameter than aperture 82 and thus foot 26 may now be simply removed from rear housing 42 by drawing foot 26 upwardly and passing head 64 through aperture 82 of cleat 81.

The present invention crib toy provides a plush figure which is securable in a novel "peering over" orientation and which is removable from the remainder of the plush toy for conventional play use. The plush toy figure is securable to the crib-side rail using the secure attachment between the plush toy figure and the opposed housings of the crib toy. The attachment mechanism utilized for securing the plush toy figure are reliable and secure while also being unobtrusive with respect to the plush figure in its separated condition. As a result, the normal play pattern of the plush figure is not compromised by the attachment mechanism.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1.For use in combination with a children's crib having a sidewall having spaced apart supports surrounding a crib interior, a crib toy comprising:

a front housing defining a front face and a rear face;

a rear housing;

clamping means for securing said front and rear housings to the crib sidewall with said front housing within said crib interior and said rear housing outside said crib interior;

a plush toy figure having a plurality of front and rear appendages;

first attachment means supported upon said front housing and said front appendages to releasibly attach said front appendages to said front housing; and second attachment means supported upon said rear housing and said rear appendages for removably attaching said rear appendages to said rear housing such that said plush toy figure straddles the crib sidewall and such that said second attachment means lock said rear appendages to said rear housing when said plush toy figure is pulled toward said crib interior whereby an infant in said crib interior is prevented from pulling said plush toy figure into said crib interior.

2. A crib toy as set forth in claim 1 wherein said second attachment means include a pair of posts, each having enlarged heads, extending from said rear housing and a pair of cleats each supported upon one of said rear appendages and each defining a first aperture larger than said enlarged heads rearwardly positioned on said rear appendage, a second aperture smaller than said enlarged heads forwardly positioned on said rear appendage and a slot therebetween.

3. A crib toy as set forth in claim 2 wherein said first attachment means includes a first pair of fabric attachment pads supported upon said front housing and a second pair of cooperating fabric attachment pads supported upon said front appendages.

4. A crib toy as set forth in claim 3 wherein said front housing includes a depressible push button and sound producing means responsive to said push button.

5. A crib toy as set forth in claim 4 wherein said cleats are formed of molded plastic material and wherein said posts are generally cylindrical.

6. For use in combination with a children's crib having an infant receiving interior and a surrounding sidewall having spaced apart supports and a top rail, a crib toy comprising:

a housing having means for attaching said housing to said sidewall;

a toy figure having a torso, head, front appendages and rear appendages;

front releasible attachment means for releasibly attaching said front appendages of said toy figure to said housing such that said front appendages extend within said surrounding sidewall and said head extends into said infant-receiving interior and said torso straddles said top rail; and rear releasible attachment means for releasibly attaching said rear appendages to said housing such that said rear appendages extend outside said infant-receiving interior and such that said rear releasible attachment means lock said rear appendages when said toy figure is pulled toward said infant-receiving interior whereby an infant within said infant-receiving interior is prevented from pulling said toy figure into said infant-receiving interior.

7. A crib toy as set forth in claim 6 wherein said toy figure resembles an animal and said front appendages are a pair of arms and said rear appendages are a pair of rear legs.

8. A crib toy as set forth in claim 7 wherein said rear releasible attachment means includes:

a pair of posts extending upwardly from said housing outside said surrounding sidewall having enlarged heads; and a pair of cleats supported upon said rear legs each having receptors for receiving said posts and locking said enlarged heads.

9. A crib toy as set forth in claim 8 wherein said front releasible attachment means includes:

a first pair of fabric attachment pads supported upon said housing; and a second pair of fabric attachment pads cooperating with said first pair of fabric attachment pads and being supported upon said arms.

10. A crib toy as set forth in claim 9 wherein each of said posts defines a narrower portion and an enlarged portion and wherein each of said receptors includes a first aperture larger than said enlarged portion and a second aperture smaller than said enlarged portion.

11. A crib toy as set forth in claim 10 wherein said head defines a face and wherein said face is facing the interior of said crib when said toy figure is secured to said housing.

* * * * *